United States Patent [19]

Baus

[11] 4,287,698

[45] Sep. 8, 1981

[54] METHOD FOR FASTENING A PROFILED CONNECTING SECTION OF A PARTITION FOR WET ROOMS TO A ROOM SURFACE, AND PROFILED CONNECTING SECTION APPLICABLE THERETO

[76] Inventor: Heinz G. Baus, Ulmenweg 45, CH-3601 Thun, Switzerland

[21] Appl. No.: 51,196

[22] Filed: Jun. 22, 1979

[30] Foreign Application Priority Data

Jun. 26, 1978 [DE] Fed. Rep. of Germany ..... 2828537

[51] Int. Cl.[3] ..... E04B 2/00

[52] U.S. Cl. ..... 52/741; 52/241

[58] Field of Search ..... 52/34, 35, 238, 241, 52/242, 285, 287, 288, 261, 239, 393, 403, 589, 590, 746, 741, 744, 391, 506

[56] References Cited

U.S. PATENT DOCUMENTS

| | | | |
|---|---|---|---|
| 3,087,586 | 4/1963 | Gray | 52/241 |
| 3,195,191 | 7/1965 | Neisewander | 52/238 |
| 3,843,475 | 10/1974 | Kent | 52/716 |

FOREIGN PATENT DOCUMENTS

| | | | |
|---|---|---|---|
| 1371647 | 7/1964 | France | 52/287 |

*Primary Examiner*—John E. Murtagh

*Attorney, Agent, or Firm*—Herbert L. Lerner

[57] ABSTRACT

Profiled connecting section of a partition for a wet room and method of fastening it to a room surface. The connecting section is disposed a short distance from the room surface and then temporarily tacked to the room surface while retaining the section away from the room surface. Subsequently, the connecting section is permanently fastened while retaining it away from the room surface by permanently cementing the long edges of connecting section to the room surface by means of an elastic adhesive sealing compound.

1 Claim, 7 Drawing Figures

METHOD FOR FASTENING A PROFILED CONNECTING SECTION OF A PARTITION FOR WET ROOMS TO A ROOM SURFACE, AND PROFILED CONNECTING SECTION APPLICABLE THERETO

BACKGROUND OF THE INVENTION

1. Field of the Invention

The invention relates to a method for fastening a profiled connecting section of a partition for wet rooms, i.e. shower stalls or bath rooms, to a room surface, i.e. a room wall, especially a tile wall, or a room ceiling. The invention further relates to a profiled connecting section which is particularly well suited for carrying out this method.

2. Description of the Prior Art

Sliding partitions and stationary partitions are placed on the rim of a bath tub or shower tub in order to prevent the shower water from splashing out. For connecting the partition to the room wall and possibly, the room ceiling, a profiled connecting section is required which is connected to the room wall, for instance, by dowels according to German Published Prosecuted Application No. 24 07 230. If the room wall consists of tiled walls, holes must be drilled into the tiles.

Further, there exists the problem of a tight connection between the profiled connecting section and the room surface. Difficulties can arise if the room surface is uneven. In that case, it is known to provide resilient sealing strips between the room surface and the profiled connecting section.

SUMMARY OF THE INVENTION

An object of the present invention is to provide a profiled connecting sect;ion and a method for fastening the profiled connecting section to a room surface in which the dowelling operation for fastening the connecting section to the room surface, i.e. room wall or room ceiling, may be eliminated.

A further object of the invention is to provide a profiled connecting section and a method for fastening the profiled connecting section to an uneven room surface, achieving a secure seal between the profiled connecting section and the room surface without the previous practice of additional sealing strips.

With the foregoing and other objects in view, there is provided in accordance with the invention a method for fastening a profiled connecting section having a substantially rectangular side, of a partition for a wet room to a room surface which comprises disposing the side of the profiled connecting section adjacent to but away from the room surface, tacking the profiled connecting section to the room surface while retaining the connecting section adjacent to but away from the room surface, and subsequently permanently cementing the long edges of the rectangular side of the profiled connecting section to the room surface by means of an elastic adhesive sealing compound while retaining the connecting section adjacent to but away from the room surface.

In accordance with the invention, there is provided a profiled connecting section of a partition for a wet room for fastening to a room surface, having a substantially rectangular side to face the room surface, a recess facing the room surface in a wall of the rectangular side, said recess extending parallel to the long edges of said rectangular side, and an elastic adhesive strip disposed in the recess for tacking the profiled connecting section to the room surface, said adhesive strip extending beyond the recess to retain the connecting section adjacent to but a desired distance away from the room surface.

There is provided a profiled connecting section of a partition for a wet room for fastening to a room surface, having an H-shape with the H-cross wall extending parallel to the room surface and two H-legs facing the room surface and two H-legs facing away from the room surface, a plurality of suction cups carried by said H-cross wall for tacking the profiled connecting section to the room surface, said suction cups extending beyond the two H-legs facing the room surface to retain the connecting section adjacent to but a desired distance away from the room surface.

In accordance with the invention a profiled connecting section of a partition for a wet room for fastening to a room surface, having an H-shape with the H-cross wall extending parallel to the room surface and two H-legs facing the room surface and two H-legs facing away from the room surface, one of said two H-legs facing the room surface is formed by an angle section detachably held at the H-cross wall, said angle section having an extension parallel to the room wall, a recess facing the room surface in said extension, an adhesive strip disposed in said recess for tacking the angle section to the room surface, said adhesive strip extending beyond the two H-legs facing the room surface to retain the connecting section adjacent to but a desired distance away from the room surface.

Other features which are considered as characteristic for the invention are set forth in the appended claims.

Although the invention is illustrated and described herein as embodied in a method for fastening a profiled connecting section of a partition for wet rooms to a room surface, and profiled connecting section applicable thereto, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
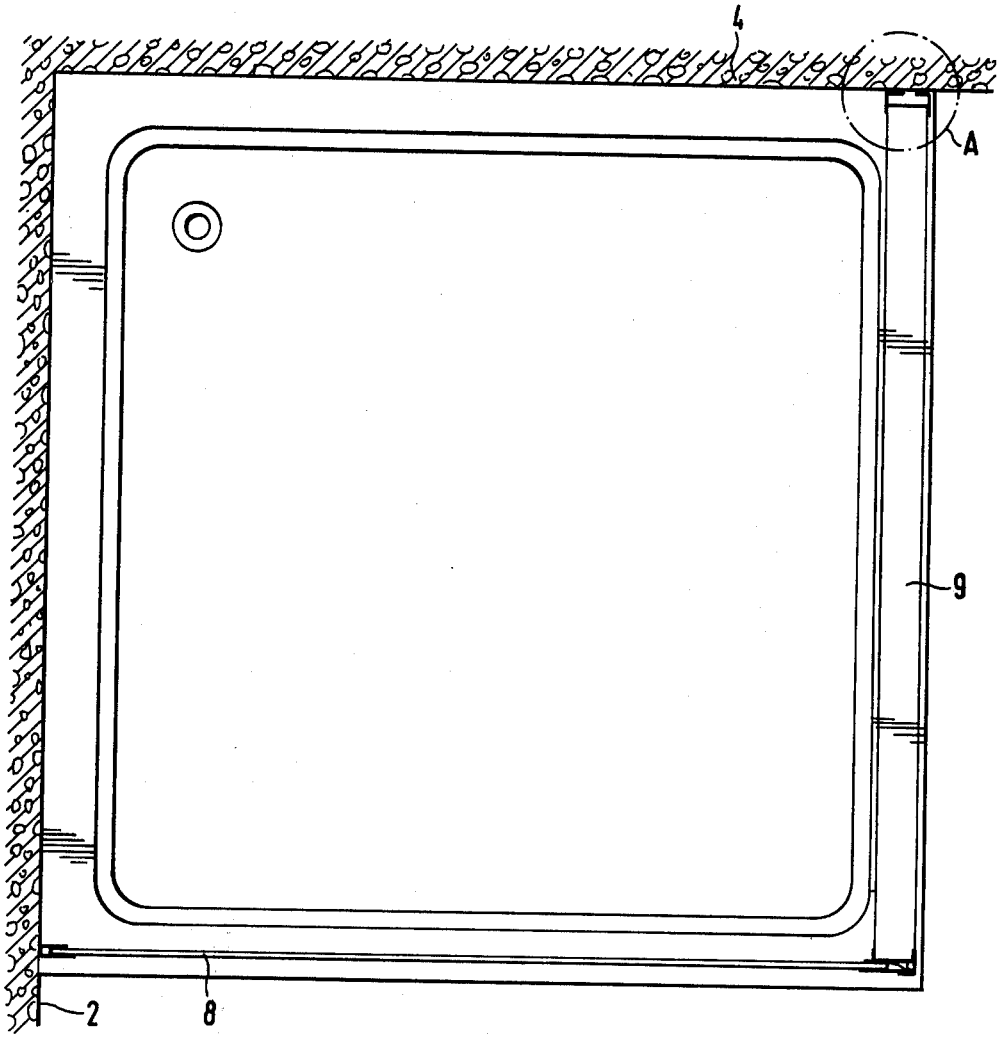
FIG. 1 shows a top view of a shower cabin built into the corner of a room with a sliding partition and a stationary partition, FIGS. 2, 3 and 4 diagrammatically show three different embodiments of the profiled connecting section fastened to the room surface according to the invention, and FIGS. 5, 6 and 7 diagrammatically show three additional different embodiments illustrating the fixation of the H-adapter section to the U-shaped part of the profiled connecting section in accordance with the invention.

The two problems of the art discussed previously are overcome in accordance with the invention by the provision that the profiled connecting section is first tacked to the room surface elastically and with little spacing therefrom and that subsequently, the long edges of the profiled connecting section adjacent to the room surface are permanently cemented to the room surface by means of an elastic adhesive sealing compound.

The profiled connecting section is advantageously tacked to the room surface by at least one adhesive strip and/or suction cups. As soon as the profiled connecting section is temporarily fixed to the respective room surface, the elastic sealing compound is applied into the gaps between the long edges of the profiled connecting sections on the one hand and the room surface on the other hand. Thereby, equalization also of major unevennesses of the room surface is achieved as well as also the mounting of the profiled connecting section, without using any tools and without damaging the tiles.

The small distance left in the temporary fixing between the profiled connecting section and the room wall must be large enough, considering the existing unevenness of the room surface, to enable the sealing compound to penetrate into the gap between the long edges of the profiled connecting section and the room surface. This distance will be dependent on the unevenness of the room and may vary from $\frac{1}{8}$ inch or less to $\frac{3}{8}$ inch or more.

The temporary fixing with the elastic adhesive strip or the suction cups facilitates the attachment of the profiled connecting section greatly. The installation is independent of unevennesses of the wall surfaces. The expansion occurring during temperature cycles of the profiled connecting sections, which are usually made of extruded aluminum, versus the material of the room surface does not loosen the attachment according to the invention, since expansion differences can be taken up by the elastic adhesive strips or the suction cups and the likewise elastic adhesive sealing compound, all of which are conventional materials. There is no danger that cracks could occur in the cemented joints or that these cemented joints could become loose.

A profiled connecting section suitable for carrying out the method, which uses at least one adhesive strip, is advanageously characterized by the feature that it has in its connecting wall at least one recess which runs parallel to its two long edges and in which the elastic adhesive strip is held. This adhesive strip extends beyond the connecting wall of the profiled section by the desired small distance.

Another profiled connection section which is suitable for carrying out the method using suction cups, is advantageously H-shaped, with the H-cross wall extending parallel to the room surface and carrying two H-legs facing the room surface and two H-legs facing away from the room surface. Further, the H-cross wall carries the suction cups which protrude by the desired small distance beyond those two H-legs facing the room surface.

In this second profiled connecting piece, the H-cross wall advantageously has an undercut longitudinal slot of T-shaped cross section, in which the T-head of the suction cups is seated with a press fit.

Another profiled connecting section suitable for carrying out the method using an adhesive strip, is characterized by the feature that it is H-shaped, with the H-cross wall extending parallel to the room surface and carrying two H-legs facing the room surface and two H-legs facing away from the room surface. One of the two H-legs facing the room surface is formed by an angle section detachably held at the H-cross wall. This angle section carries an extension parallel to the room wall. This extension has a recess in which an elastic adhesive strip is held which protrudes by the desired small distance beyond those two H-legs which are facing the room surface. On occasion, the width of the partition is smaller than the wall surface to be covered, so that there is a gap between the profiled connecting section and the room wall. It is a further object of the invention to describe a profiled connecting section, the width of which can be adjusted in such a manner that such a gap can be bridged. It is desirable in this connection to make possible a continuous adjustment of the width of the profiled connecting section and to secure the adjusted width without the use of tools.

Such settability of the width of the profiled connecting section which can be carried out without the use of tools is desirable, particularly if no tools of any kind are used in fastening the profiled connecting section to the room wall.

A continuously adjustable profiled connecting section advantageously has two legs which are arranged at the connecting wall or the H-cross wall of the U-shaped part. The two legs extend perpendicular to the room surface and face away from the latter. These two legs are surrounded by two legs of an H-adapter section, the other two legs of which accept or receive the movable or stationary panel of the partition. The H-adapter section may be fixed at different distances from the connecting wall or the H-cross wall by moving the two legs of the H-adapter closer to or further from the wall. For fixing the H-adapter section to the U-shaped part at mutually touching surfaces extending perpendicular to the room surface of the U-shaped part on the one hand and of the H-adapter section on the other hand, slots filled with adhesive are advantageously provided.

Advantageous embodiment examples of the invention are shown schematically in the drawings.

FIG. 1 shows in a top view a shower stall which is arranged in the angle between two room walls 2 and 4. The shower stall has a sliding partition 9 with movable wall panels and a stationary partition 8 with immovable panels. The shower stall is entered and left through the sliding partition 9.

Figure 3:
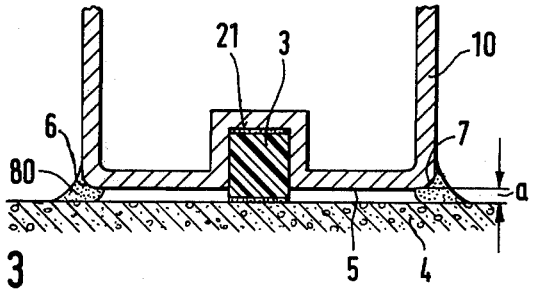
Figure 4:
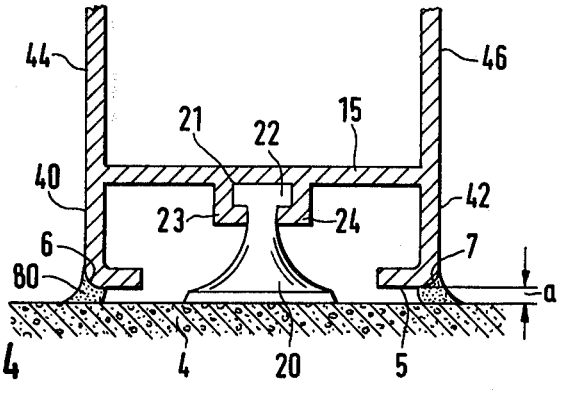

The fastening of the sliding partition 9 to the room wall 4 is designated by A in FIG. 1. Different embodiments of this fastening are shown in FIGS. 2, 3 and 4.

Figure 2:
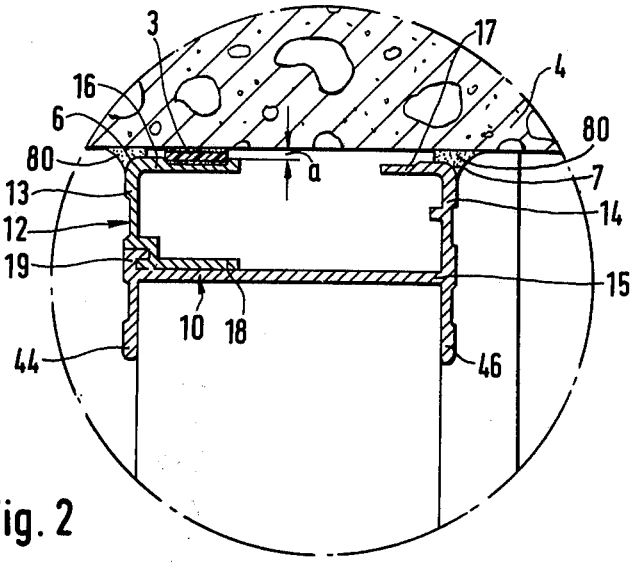

As can be seen from FIG. 2, the profiled connecting section 10 has a cross section of substantially H-shape. The H-legs 13 and 14 intended for the connection to the room wall have extensions 16 and 17 which are parallel to the H-cross wall 15 of the connecting section 10 and which H-legs extend toward each other. The left H-leg 13 as well as its extension 16 are part of the angle section 12. Angle section 12 with its part 18 which extends parallel to the H-cross wall 15 holds H-cross wall 15.

A recess 21 open toward the room wall 4 is located in the extension 16. The sealing strip 3, cemented into this recess 21, protrudes by the small distance a beyond the H-legs 13 and 14 of the profiled connecting section 10.

The two rounded longitudinal corners 6 and 7 are cemented to the room wall 4 or a room ceiling by means of an elastic sealing compound 80.

The two-part design of the profiled connecting section 10 shown in FIG. 2 permits, first, a temporary fixation of the angle section 12 by means of the adhesive strip 3. Then, the remaining part of the profiled connecting section 10 is placed on the angle section 12 and is connected to the angle section 12 via a tongue-and-groove joint 19, preferably without the use of screws. Ultimately, the two gaps between the longitudinal corners 6 and 7 of the profiled connecting section 10 and the room wall 4 are sealed by means of the sealing compound 80.

In FIG. 3, another profiled connecting section 10 according to the invention is shown. It may be used as the connecting section designated A in FIG. 1. The profiled connecting section 10 of FIG. 3 has a U-shaped cross section. It has a recess 21 in the connecting wall 5 facing the room wall 4, extending in the longitudinal direction of the section 10. The sealing strip 3 is arranged in this recess 21. The sealing strip 3 extends, as per FIG. 2 beyond the connecting wall 5 by the minimum distance a.

After the connecting section 10 shown in FIG. 3 is temporarily fixed by means of the adhesive strip 3 to the room wall 4, the two rounded longitudinal corners 6 and 7 are connected firmly to the room wall or the room ceiling 4 by means of the elastic adhesive sealing compound 80.

FIG. 4 shows a connecting section of H-shaped cross section. The H-cross wall 15 extends parallel to the room surface 4. The H-cross wall 15 carries two H-legs 40 and 42 extending from wall 15 toward the room surface 4 and further H-legs 44 and 46 extending away from the room surface 4.

The H-cross wall 15 carries on its side facing the room surface 4, longitudinal webs 23 and 24 which extend in the lengthwise direction of the section and carry strips facing each other; these strips together with the longitudinal webs 23 and 24 form a T-shaped undercut longitudinal slot.

The suction cups 20 (of approximately rotation-symmetrical cross section) carry T-heads 22. The T-heads 22 sit in the longitudinal slot with a press fit, lined up one after the other.

Like the adhesive strip 3 in FIGS. 2 and 3, the suction cups 20 extend beyond the H-legs 40 and 42 by the distance a, so that this minimum distance a between the profiled connecting section 10 and the room surface or room wall 4 is assured and enough sealing compound 80 can be placed in the gap between the longitudinal corner 6 and 7 on the one hand and the room surface 4 on the other hand to obtain good adhesion.

Figure 5:
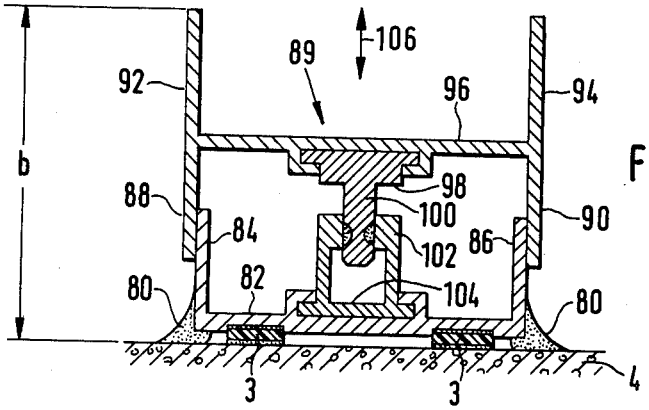
Figure 6:
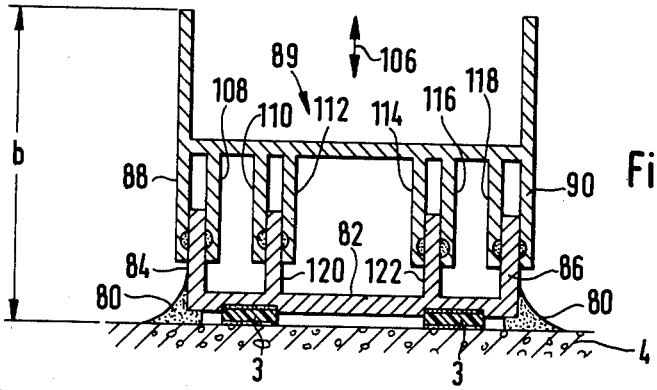
Figure 7:
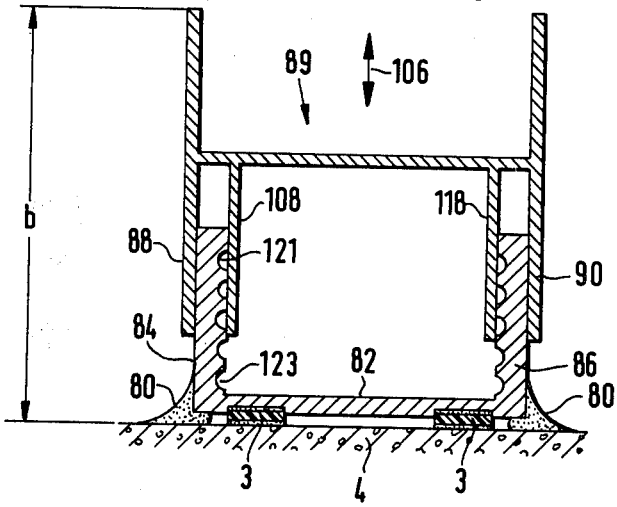

FIGS. 5, 6 and 7 show parts 82 of a connecting section which have a substantially U-shaped cross section. These parts are tacked to the room surface 4, similar to the connecting section shown in FIG. 3, by means of adhesive strips 3 and are cemented by means of a sealing compound 80.

The lateral U-legs 84 and 86 of the U-shaped part 82 are surrounded by the H-legs 88 and 90 of an H-adapter section 89. The two other H-legs 92 and 94 of the H-adapter section 89 accept or receive the movable or stationary wall panels of the partition.

The H-adapter section 89 is movable in the direction of the double arrow 106 relative to the U-shaped part 82 to adjust the width b of the profiled connecting section. In this process, the H-legs 88 and 90 of the H-adapter section 89 slide on the U-legs 84 and 86 of the U-shaped part 82.

The desired adjustment is fixed by the provision that surfaces of the U-shaped part 82 extending perpendicularly to the room surface 4 on the one hand, and of the H-adapter section 89 on the other hand, have slots which are filled with adhesive. If the surfaces of the U-shaped part 82 extending perpendicularly to the room surface 4 on the one hand, and of the H-adapter section 89 on the other hand, move relative to each other, some adhesive is distributed on the surfaces that slide on each other. In the desired end position, the adhesive sets and thereby causes the desired fixation of the final position.

The arrangement of the slots is shown in three different embodiments in FIGS. 5, 6 and 7.

According to FIG. 5, and undercut T-slot is provided in the H-web 96 of the H-adapter section 89 as well as at the opposite surface of the U-shaped part 82. These two undercut T-slots are opposite each other. The holding plate 98 of a pin 100 is attached with a press fit in the undercut T-slot of the H-adapter section 89. This cylindrical pin 100 fits closely into the cylindrical opening of a cylindrical chamber 102 which is seated via a further holding plate 104 in the undercut T-slot of the U-shaped part 82.

Since the undercut T-slots have the same cross section, the parts 100 and 102 can be interchanged, or these parts can be mounted alternatingly at the top or at the bottom.

The two parts 100 and 102 touch each other in cylindrical surfaces which extend perpendicular to the wall surface 4. In one of these cylindrical surfaces (in the embodiment example shown, in the cylindrical outside surface of the pin 100), slots are provided which are filled with adhesive. If the H-adapter section 89 is moved in the direction of the double arrow 106, adhesive is distributed on the cylindrical surfaces of the parts 100 and 102. In the final position reached the adhesive sets and fixes this end position, so that the desired width b is set.

According to FIG. 6, the H-web 96 of the H-adapter section 89 has, in addition to the two H-legs 88 and 90, parallel ribs 108, 110, 112 114, 116 and 118. The leg 88 with the rib 108 encloses the U-leg 84 of the U-shaped part 82. Similarly, the leg 90 with the rib 118 encloses the U-leg 86 of the U-shaped part 82. The two pairs 110, 112 and 114, 116 of ribs enclose the two ribs 120 and 122 of the U-shaped part 82 between them.

The ribs and H-legs (88, 108, 110, 112, 114, 116, 118 and 90) of the H-adapter section 89 touch the U-legs and ribs (84, 120, 122, 86) of the U-shaped part 82 in plane surfaces which extend perpendicular to the room wall 4 in the longitudinal direction of the connecting section. Slots arranged in these plane surfaces are filled with adhesive like the slots of the cylinder surfaces of the pins 100 in FIG. 5. If the H-adapter section 89 is adjusted in the direction of the double arrow 106, then the adhesive is distributed on the plane sliding surfaces which are perpendicular to the wall surface 4. When the adjustment process is completed, the adhesive sets and fixes the H-adapter section 89 in the desired position relative to the U-shaped part 82.

FIG. 7 shows an arrangement similar to FIG. 6, but without the inner ribs 110, 112, 114, 116, 120 and 122. A large number of longitudinal slots extending perpendicular to the drawing plane are provided on the insides of the U-legs 84 and 86 of the U-shaped part 82. These U-legs are surrounded by the H-legs or ribs 88, 108, 118 and 90 of the H-adapter section. Depending on the range, in which the width b of the H-adapter section 89 is to be adjusted, a higher slot 121 or a lower slot 123 or, as shown, a middle slot is filled with adhesive. The adhesive is spread by movement in the direction of the double arrows 106 on the surfaces touching each other of the U-legs 84, 86 and the ribs 108, 118 in a manner similar to the case of the profiled connecting section of FIG. 6. After the adjustlment is completed, the adhesive sets and fixes the H-adapter section 89 of the profiled connecting section at the U-shaped part 82 of the profiled connecting section.

There are claimed:

1. Method for fastening a profiled connecting section having a substantially rectangular side, of a partition for a wet room to a room surface which comprises disposing the side of the profiled connecting section adjacent to but away from the room surface, tacking the profiled connection section by means of an elastic adhering device to the room surface while retaining the connecting section adjacent to but away from the room surface, and subsequently permanently cementing the long edges of the rectangular side of the profiled connecting section to the room surface by means of an elastic adhesive sealing compound while retaining the connecting section adjacent to but away from the room surface, wherein at least one adhesive strip is used for tacking.

* * * * *